US005775245A

United States Patent [19]

Sato et al.

[11] Patent Number: 5,775,245

[45] Date of Patent: Jul. 7, 1998

[54] BED SLIDE DEVICE OF A SEWING MACHINE

[75] Inventors: Shuichi Sato, Utsunomiya; Yoshimi Koguchi, Imaichi, both of Japan

[73] Assignee: The Singer Company N.V., Curaco, Netherlands Antilles

[21] Appl. No.: 815,248

[22] Filed: Mar. 12, 1997

[30] Foreign Application Priority Data

May 10, 1996 [JP] Japan ..... 8-140741

[51] Int. Cl.[6] ..... D05B 73/12

[52] U.S. Cl. ..... 112/260

[58] Field of Search ..... 112/260, 163, 112/168, 258

[56] References Cited

U.S. PATENT DOCUMENTS

| | | | |
|---|---|---|---|
| 3,373,709 | 3/1968 | Gubbay et al. | 112/260 |
| 3,545,393 | 12/1970 | Meier | 112/260 |
| 4,646,665 | 3/1987 | Jimenez et al. | 112/260 |

*Primary Examiner*—Peter Nerbun
*Attorney, Agent, or Firm*—McCormick, Paulding & Huber

[57] ABSTRACT

A bed slide comprises a bed slide body which is slidably provided on the bed, and a closing plate being disposed at a portion adjacent to the bed slide body in a sliding direction thereof, wherein the closing plate is placed on a stage surface of the bed, and is supported by the bed slide body with a hinge device to be opened or closed.

3 Claims, 7 Drawing Sheets

BED SLIDE DEVICE OF A SEWING MACHINE

BACKGROUND OF THE INVENTION

1. Field of the Invention

The present invention relates to a bed slide device which is mounted on a bed of a sewing machine.

2. Prior Art

A bed slide is provided at a portion adjacent to a throat plate of a bed of a sewing machine and it is a window plate to be slidably mounted on the bed, and it covers a space over a hook so as to open or close the space. A conventional bed slide of an industrial sewing machine having two needles is illustrated in FIGS. 12 through 14. In the sewing machine of this type, a pair of hooks 6 and 6 corresponding to two needles, not shown, are disposed under a throat plate 3 at left and right both sides of the throat plate 3, and two bed slides 4 and 5 are mounted on the bed 2 corresponding to the hooks 6 and 6. The bed 2 is disposed on the machine table 1 by way of a rubber cushion 7 and it is arranged to be opened or closed with respect to a machine table 1 with a hinge 25, and an inside of the machine table 1 can be opened by pushing up the bed 2 forward.

Each of the bed slides 4 and 5 is slidably engaged at back-and-forth both ends thereof in sliding grooves comprising dovetail grooves which are defined in parallel with each other in confronting relation on a part close to an upper surface of the bed 2, and it is opened when inspecting the interior of the bed 2 or supplying a bobbin thread. More in detail, dovetail parts 4*a* and 5*a* of the bed slides 4 and 5 defined at back-and-forth both side edges shown in FIG. 14 are retained by the sliding grooves 2*b*, so that the bed slides 4 and 5 can slide only rightward and leftward, i.e. in the lateral direction. The left bed slide 4 moves on the machine table 1 to open a space over the hook 6 while the right bed slide 5 is received by a concave 2*a* defined in the upper surface of the bed 2 so as to open the space over the hook 6. For example, when the bobbin thread is supplied, an operator catches his or her fingers in the retaining concaves 4*b* and 5*b* so as to slide the left bed slide 4 leftward and slide the right bed slide 5 rightward (in the direction denoted by arrows A or B shown in FIG. 12), so that the space over the hook 6, is opened for replacing a bobbin or a bobbin case with another one. Accordingly, opening or closing operation of the bed slides 4 and 5 by the operator is performed every time the bobbin thread is supplied during a sewing work.

However, in the conventional bed slide device has the following technical problems.

Particularly in case of a bed slide for use in an industrial sewing machine having two needles, the lower surface of the left bed slide 4 as viewed from the operator interferes with the upper surface of the machine table 1 to prevent the left bed slide 4 from being smoothly slid, thereby it makes difficult to open the space over the hook 6. This is caused by the fact that a gap t between the upper surface of the machine table 1 and the lower surface of the left bed slide 4 is small.

A stage difference S between the upper surface of the machine table 1 and the upper surface of the bed 2 (the upper surface of the bed 2 is flush with that of the left bed slide 4) is preferable to be as small as possible so as to smoothly handle a cloth during the sewing operation, and it is ideally desired that the upper surface of the machine table 1 is flush with to have the same plane extending to that of the bed 2. Accordingly, the gap t is set to be as small as possible to an extent that the lower surface of the left bed slide 4 does not interfere with the upper surface of the machine table 1.

Meanwhile, the stage difference S or the gap t is liable to be smaller than that which is set at first owing to the deformation of a rubber cushion 7 as time elapses wherein the rubber cushion 7 is interposed between the machine table 1 and the bed 2 for preventing oscillation.

When the left bed slide 4 interferes with the upper surface of the machine table 1 while the bed 2 remains placed on the machine table 1, thereby making it difficult to open or close the left bed slide, the operator a pushes up the bed 2 forward (in the direction of the arrow P in FIG. 14) together with an arm of the sewing machine, not shown, and the bed 2 is turned about a hinge 25 so that the left bed slide 4 can be opened or closed at a position where the lower surface of the left bed slide 4 does not interfere with the upper surface of the machine table 1. On the other hand, since the concave 2*a* for receiving the sliding right bed slide 5 is defined in the upper surface of the bed 2, the right bed slide 5 slides rightward so as to open the space over the right hook 6 regardless of the length of the stage difference S defined between the upper surface of the machine table 1 and that of the bed 2.

In the conventional bed slide device of the sewing machine, whenever the left bed slide 4 is opened or closed for replacing the bobbin with another one, there are following technical problems when pushing up the bed 2 forward together with the arm of the sewing machine, not shown.

(1) Particularly, since the industrial sewing machine has a heavy weight, there is a problem in view of securing safety and protection of an operator.

(2) It takes time and labor for replacing a bobbin with another one, causing a problem in working efficiency and economic aspect.

SUMMARY OF THE INVENTION

The present invention has been made in view of the conventional technical problems, and it is an object of the invention to provide a bed slide device having the following arrangement.

A bed slide device of a first aspect of the invention comprises a bed of a sewing machine, and a bed slide slidably provided on the bed for opening and closing a space over a hook, wherein the bed slide device is characterized in that the bed slide further comprises a bed slide body being slidably provided on the bed, and a closing plate being disposed at a portion adjacent to the bed slide body in a sliding direction thereof, and wherein the closing plate being placed on a stage surface of the bed, and is supported by the bed slide body with a hinge device so as to be opened or closed.

A bed slide device of a second aspect of the invention comprises a bed of a sewing machine, and a bed slide slidably provided on the bed for opening and closing a space over a hook, wherein the bed slide device is characterized in that the bed slide further comprises a bed slide body being slidably provided on the bed, and a closing plate being disposed at a portion adjacent to the bed slide body in a sliding direction thereof, and wherein the closing plate is placed on a stage surface of the bed, and is detachable vertically with respect to the bed slide body, and fixing means for detachably fixing the closing plate onto the bed.

A bed slide device of a third aspect of the invention is an improvement of a bed slide device of a sewing machine of the second aspect of the invention, wherein the closing plate defines a convex at one end thereof, and the convex is enlarged toward one end thereof, and the bed slide body defines a concave at another end thereof which is fitted to the convex, and wherein the convex is detachable vertically with respect to the concave.

PREFERRED EMBODIMENTS OF THE INVENTION

First Embodiment (FIGS. 1 through 6, and FIG. 11)

A bed slide device according to a first embodiment, wherein the present invention is applied to the left bed slide of the industrial sewing machine having two needles, will be now described with reference to FIGS. 1 through 6 and FIG. 11.

Figure 6:
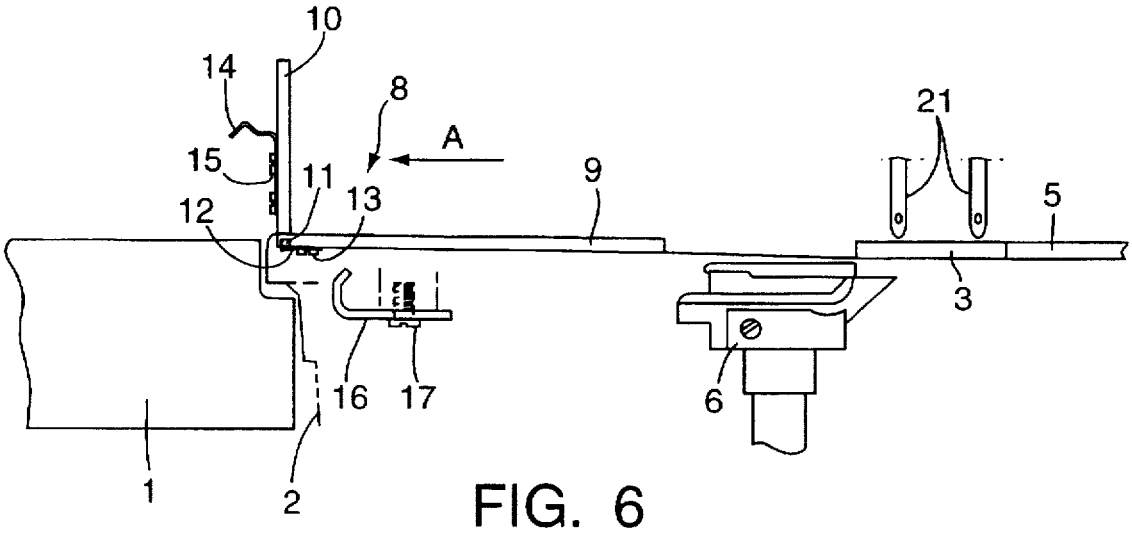
FIG. 6 is a view for explaining another operation of the bed slide device.
Figure 7:
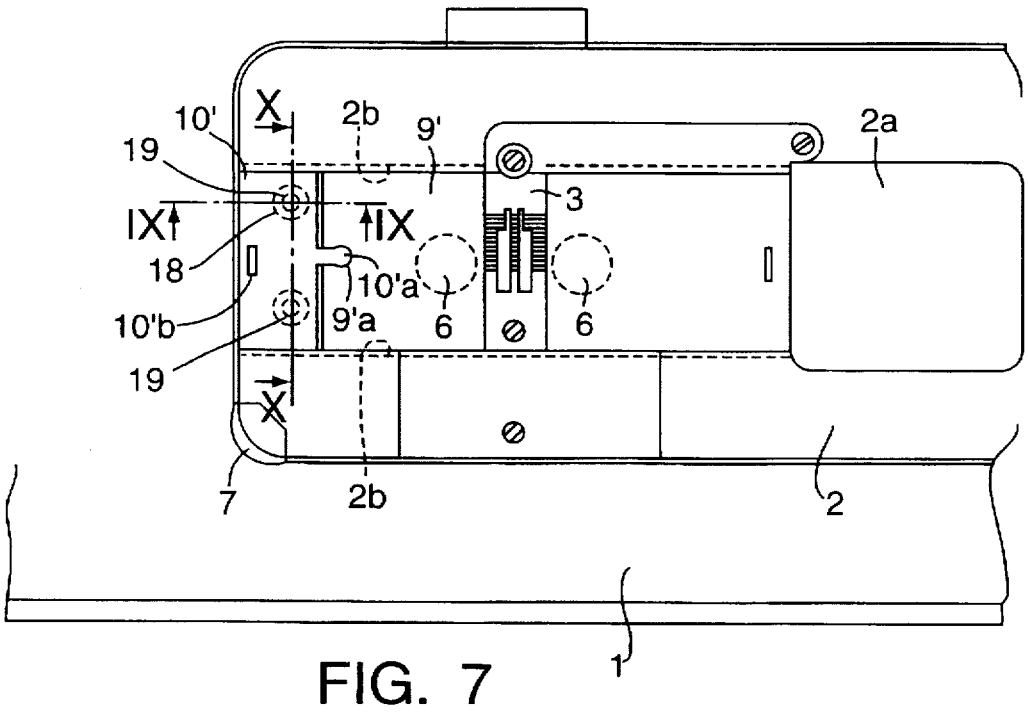
FIG. 7 is a plan view of a bed slide device of a sewing machine according to a second embodiment of the present invention.

In FIG. 6, denoted by 1 is a sewing machine table, 2 is a bed, 3 is a throat plate, 5 is a right bed slide, 6 is a hook, wherein these components are substantially the same as the conventional ones. Denoted by 21 is a pair of needles.

A left bed slide 8 is disposed at the left side while it is arranged at a portion adjacent to the throat plate 3, and it comprises a bed slide body 9 which can slide only rightward and leftward, i.e., in the lateral direction with respect to the bed 2 and a closing plate 10 which is arranged at a portion adjacent to the bed slide body 9 in the sliding direction of the bed slide body 9. The closing plate 10 is connected to the left side of the bed slide body 9 with a hinge device (11, 12 and 14), and it is swingable. The hinge device (11, 12 and 14) comprises a hinge pin 11, hinge pin presser bar plates 12 and a hinge pin presser bar spring 14.

Figure 1:
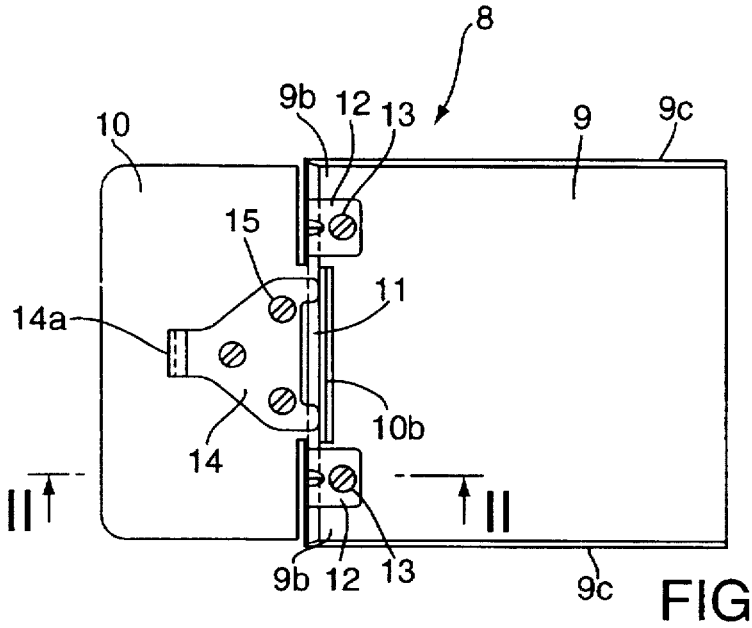
FIG. 1 is a bottom view of a bed slide device of a sewing machine according to a first embodiment of the present invention.
Figure 2:
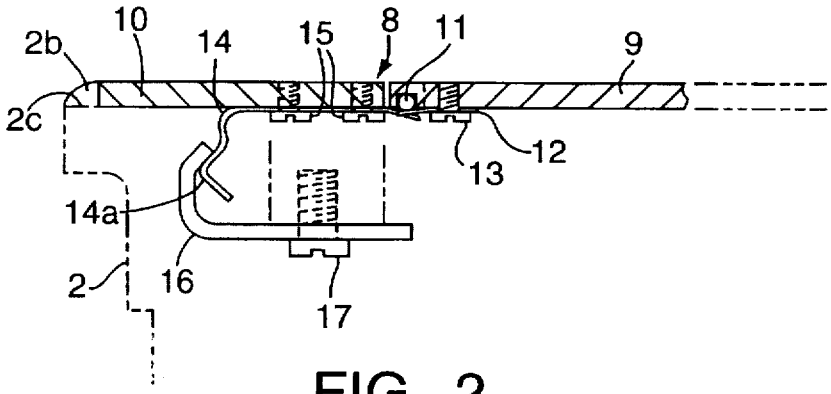
FIG. 2 is an enlarged cross sectional view taken along the line II—II of FIG. 1.
Figure 3:
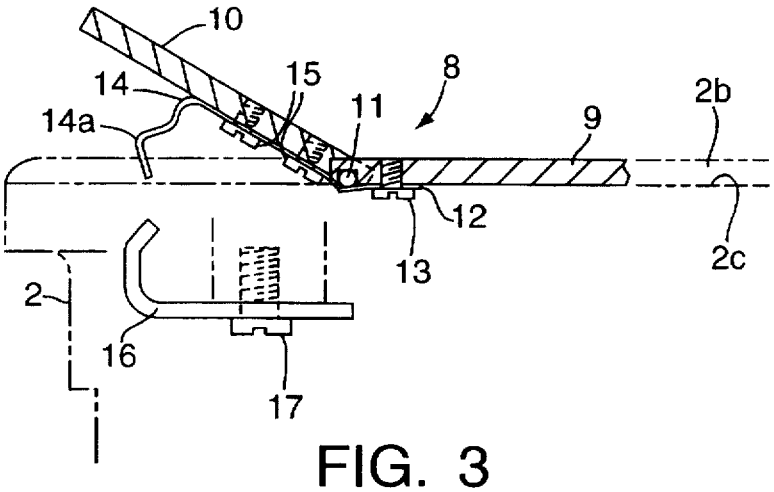
FIG. 3 is a cross sectional view showing a state where a closing plate is operated.
Figure 4:
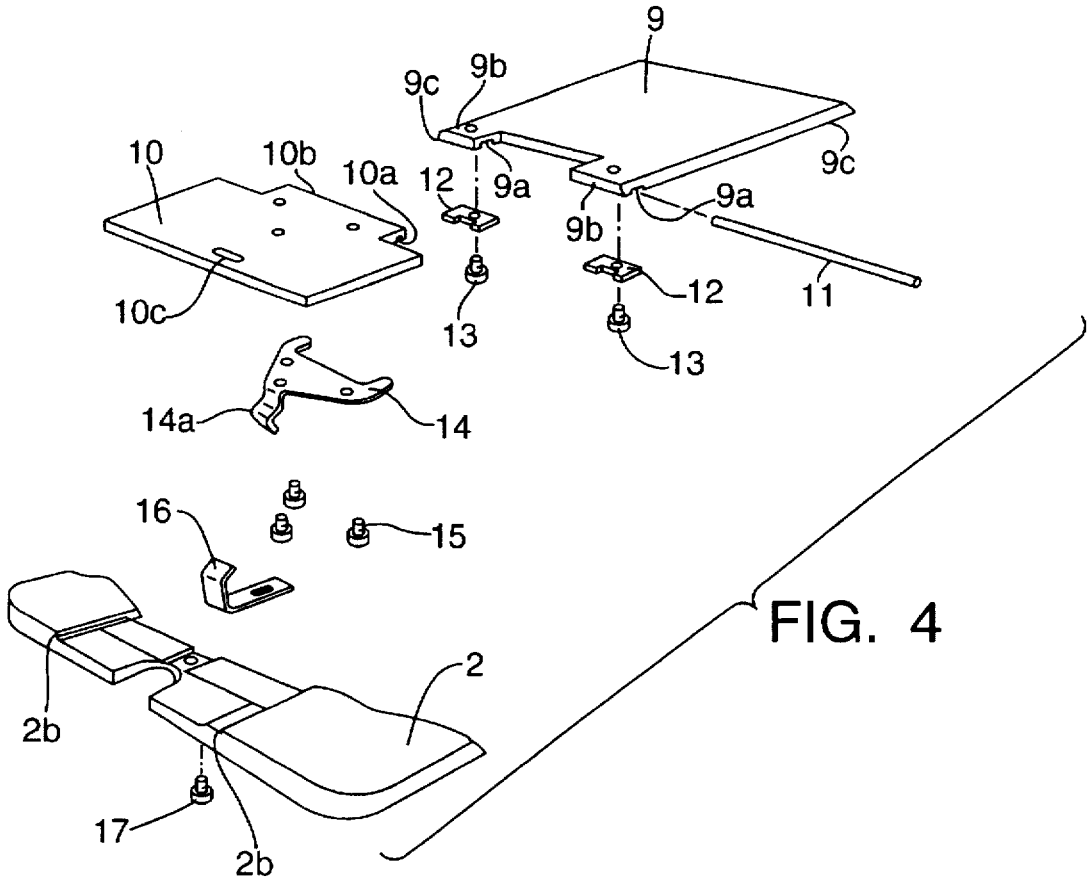
FIG. 4 is an exploded perspective view of a bed slide device of the sewing machine including a part of a bed.

As shown in FIG. 4, the hinge pin 11 is received by a pin groove 10*a* which is defined in the lower surface of a central projection 10*b* of the closing plate 10 at one end thereof (end close to the throat plate 3), and a pin groove 9*a* which is defined in the lower surface of projections 9*b* of the bed slide body 9 at both sides of another end (end remote from the throat plate 3) of the bed slide body 9. The hinge pin presser bar plates 12 are fixed to the lower surfaces of the projections 9*b* of bed slide body 9 with set screws 13, and they support the lower surface of the hinge pin 11 at back-and-forth both ends thereof. The hinge pin presser bar spring 14 is fixed to the central lower surface of the closing plate 10 with set screws 15, and one end of the hinge pin presser bar spring 14 supports the lower surface of the hinge pin 11 at the central portion thereof. Meanwhile, the hinge pin 11 received by the pin grooves 9*a* and the pin groove 10*a* is pressed by the hinge pin presser bar plates 12 and the hinge pin presser bar spring 14 so as to permit the closing plate 10 to be opened or closed or swung in the vertical direction with respect to the bed slide body 9.

The other end of the hinge pin presser bar spring 14 extends downward and is curved to form a curved portion 14*a*, wherein the curved portion 14*a* is elastically retainable by a hinge pin presser bar spring receiver 16 fixed to the bed 2 with a set screw 17. In a state where the curved portion 14*a* of the hinge pin presser bar spring 14 is elastically retained by the hinge pin presser bar spring receiver 16, the closing plate 10 is firmly fixed to the bed 2 so as to prevent the closing plate 10 from being jolted by oscillation during the operation of the sewing machine. In this state, the upper surfaces of the bed slide body 9 and closing plate 10 are flush with to have the same plane extending to that of the bed 2. The curved portion 14*a* of the hinge pin presser bar spring 14 is elastically moved away from the hinge pin presser bar spring receiver 16 when the operator catches his or her fingers in a concave 10*c* defined in the other end of the closing plate 10 so as to pull up the other end of the closing plate 10.

Figure 11:
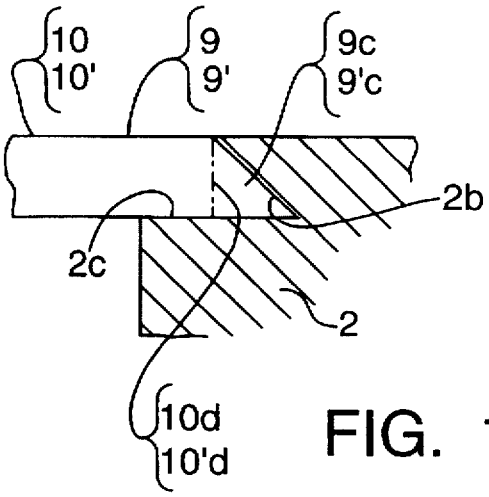
FIG. 11 is a cross sectional view showing a relation between the bed slide, a closing plate and a sliding mechanism of a bed according to the first and second embodiments of the present invention.

Dovetail parts 9*c* defined at back-and-forth both ends of the bed slide body 9 having such an arrangement are slidably engaged in sliding grooves 2*b* which are defined in the back-and-forth both sides of the bed 2 and extend in the lateral direction as shown in FIG. 11, wherein the closing plate 10 is placed on a stage surface 2*c* connected to the lower surfaces of sliding grooves 2*b* of the bed 2, and portions adjacent to back-and-forth both end surfaces 10*d* as shown in one dotted chain line in FIG. 11 can be moved upward without interfering with the sliding grooves 2*b*.

The sliding grooves 2*b* for receiving the left bed slide 8 are defined in the left end close to the upper surface of the bed 2, and the left end is opened. In such a manner, the dovetail parts 9*c* of the bed slide body 9 are retained by the sliding grooves 2*b* comprising the dovetail grooves so that the bed slide body 9 can slide only in the lateral direction with respect to the bed 2. Further, the closing plate 10 is shorter than the bed slide body 9 in the width of the back-and-forth directions by the dovetail part 9*c*, and it is structured not to be retained by the sliding grooves 2*b*.

The operation of the left bed slide 8 will be now described.

Figure 5:
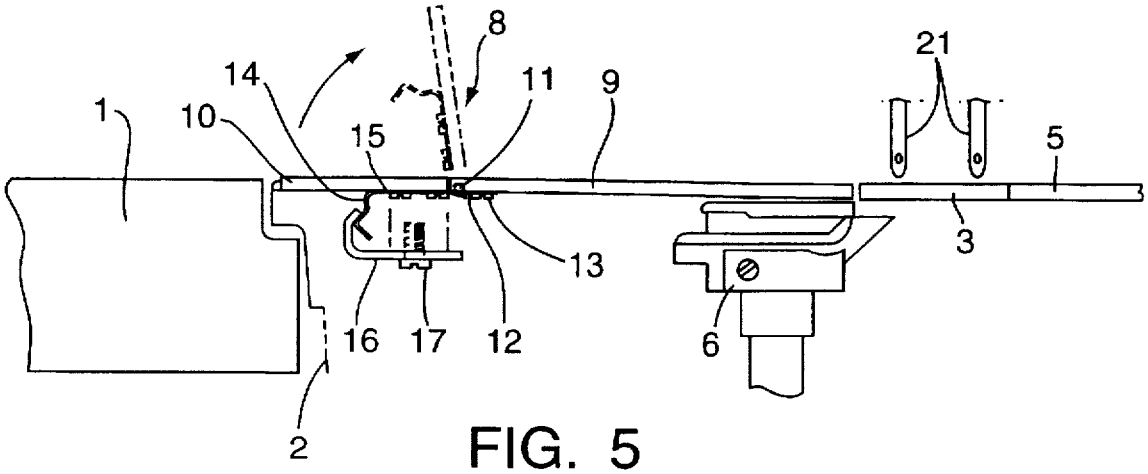
FIG. 5 is a view for explaining an operation of the bed slide device.

When the bobbin or bobbin case is replaced with another one while the space over the hook 6 is opened for supplying the bobbin thread, the left bed slide 8 is slid in the direction of the arrow A in FIG. 6 to thereby open the space over the hook 6. Firstly, the closing plate 10 is swung upwardly to open a space over the hinge pin presser bar spring 16. At this time, when the operator catches his or her fingers in the concave slot 10*c* and jumps up the left end of the closing plate 10, the curved portion 14*a* of the hinge pin presser bar spring 14 is elastically moved away from the hinge pin presser bar spring receiver 16 so that the closing plate 10 is turned about the hinge pin 11 so as to permit the closing plate 10 to stand substantially upright as shown in FIG. 5.

Then when the operator slides the bed slide body 9 leftward in a state where the closing plate 10 is opened, the space over the hook 6 is opened. The bed slide body 9 is moved together with the closing plate 10 when the closing plate 10 is moved. Since the bed slide body 9 can be moved freely in the sliding grooves 2*b* of the bed 2 by the length (width) of the jumped up closing plate 10 in the lateral direction, it is possible to define an opening needed for replacing the bobbin with another one over the hook 6 without interfering with the upper surface of the machine table 1. The operator replaces the bobbin or bobbin case in the hook 6 with another one in this state.

Figure 12:
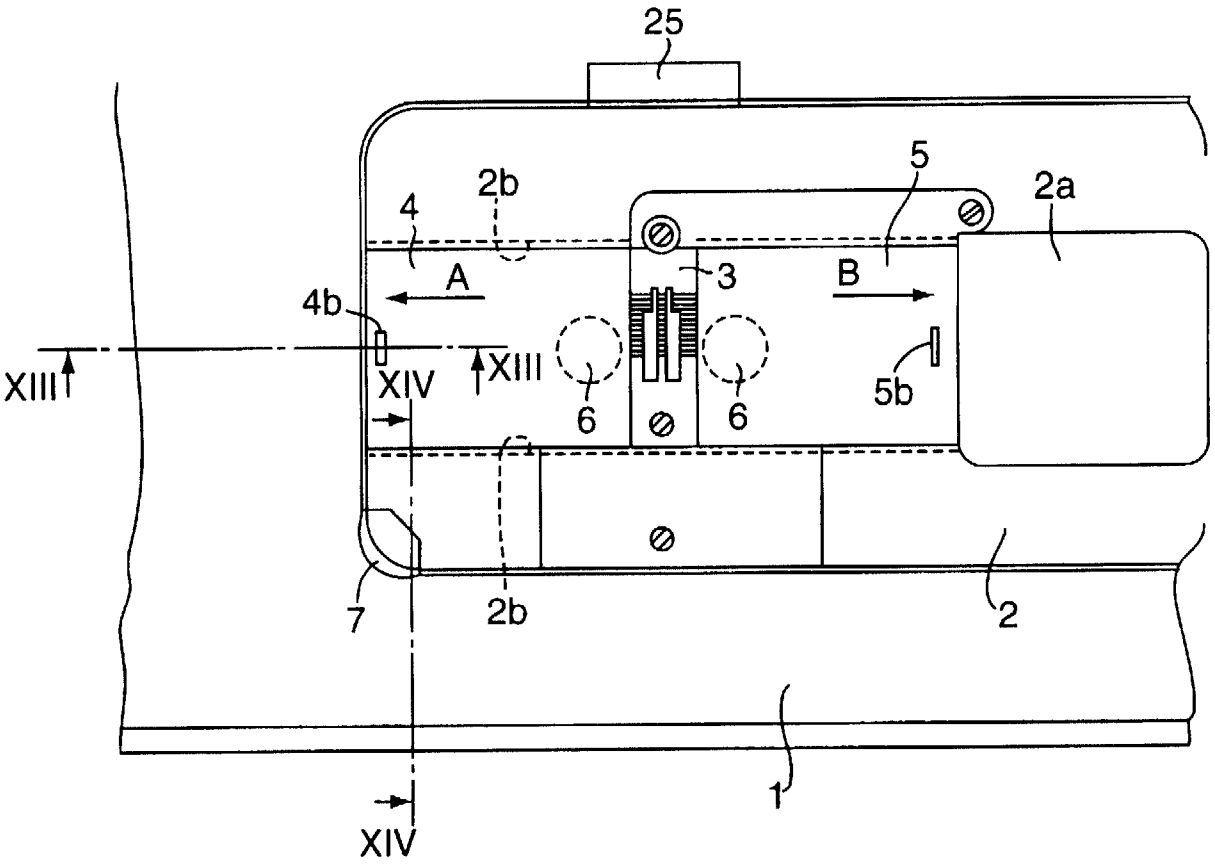
FIG. 12 is a plan view showing a conventional bed slide device of a sewing machine.
Figure 13:
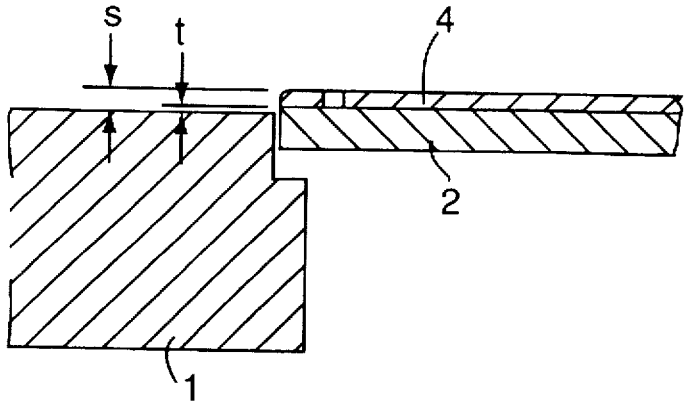
FIG. 13 is an enlarged cross sectional view taken along the line XIII—XIII of FIG. 12.
Figure 14:
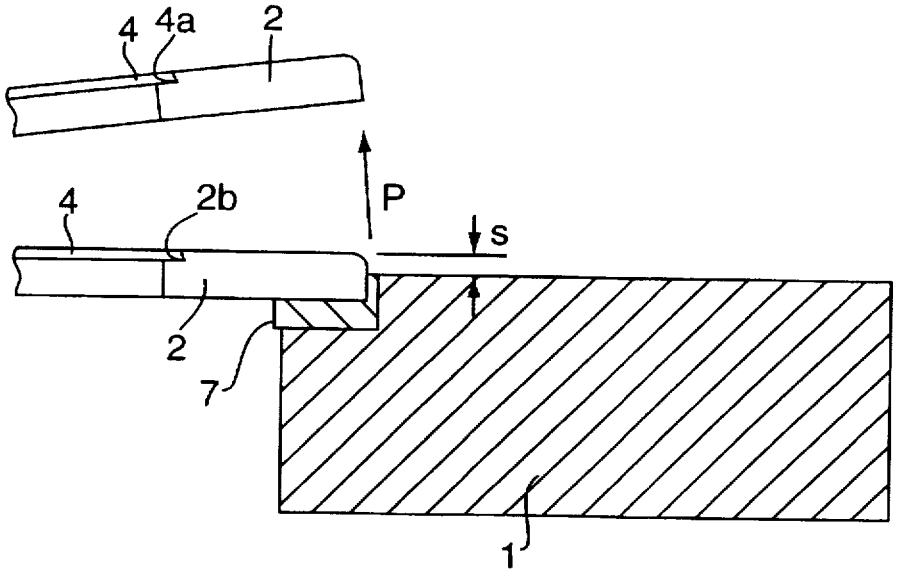
FIG. 14 is an enlarged cross sectional view taken along the line XIV—XIV of FIG. 12.

It is not necessary to move the bed slide body 9 to be positioned onto the upper surface of the machine table 1 so as to open the space over the hook 6. Accordingly, it is possible to permit the upper surface of the machine table 1 to be flush with to have substantially the same plane to extend to that of the bed 2. As a result, it is possible to solve the problem that the cloth is prevented from being handled during the sewing operation which is caused by the stage difference between the upper surface of the machine table 1 and that of the bed 2 or that of the left bed slide 8. It is needless to say that a concave surface like the concave surface 2*a* of the upper surface of the bed 2 (shown in FIG. 12) defined corresponding to the right bed slide 5 is defined corresponding to the left bed slide 8 so that the left bed slide 8 need not be received by such concave, thereby preventing the cloth from being handled during the sewing operation.

After the bobbin or bobbin case in the hook 6 is replaced with another one, the bed slide body 9 is slid rightward (in a direction opposite to the arrow A). Then, the closing plate 10 is turned about the hinge pin 11 and it is placed on the stage surface 2*c* of the bed 2, then the curved part 14*a* of the hinge pin presser bar spring 14 is elastically retained by the hinge pin presser bar spring receiver 16. As a result, the space over the hook 6 is closed.

Meanwhile, although it is possible to dispose the closing plate 10 at one end of the bed slide body 9 (end close to the throat plate 3), a trouble in replacing the bobbin or bobbin case in the hook 6 with another one is liable to occur owing to the existence of the closing plate 10 which stands upright. Accordingly, it is advisable to attach the closing plate 10 to the other end of the bed slide body 9 (end remote from the throat plate 3), so that the closing plate 10 is swung at the part remote from the throat plate 3. Since the sliding grooves 2*b* of the bed 2 are formed to extend to the left end of the bed 2, it is possible to remove the entire bed slide 8 from the bed 2 at a position where the bed 2 is pushed up forward together with the arm, not shown, so that the bed slide body 9 does not interfere with the upper surface of machine table 1.

Second Embodiment (FIGS. 7 through 11)

A bed slide device according to a second embodiment will be now described with reference to FIGS. 7 through 11.

Components which have substantially the same functions as those in the first embodiment are denoted by the same numerals and explanations thereof is omitted.

Figure 8:
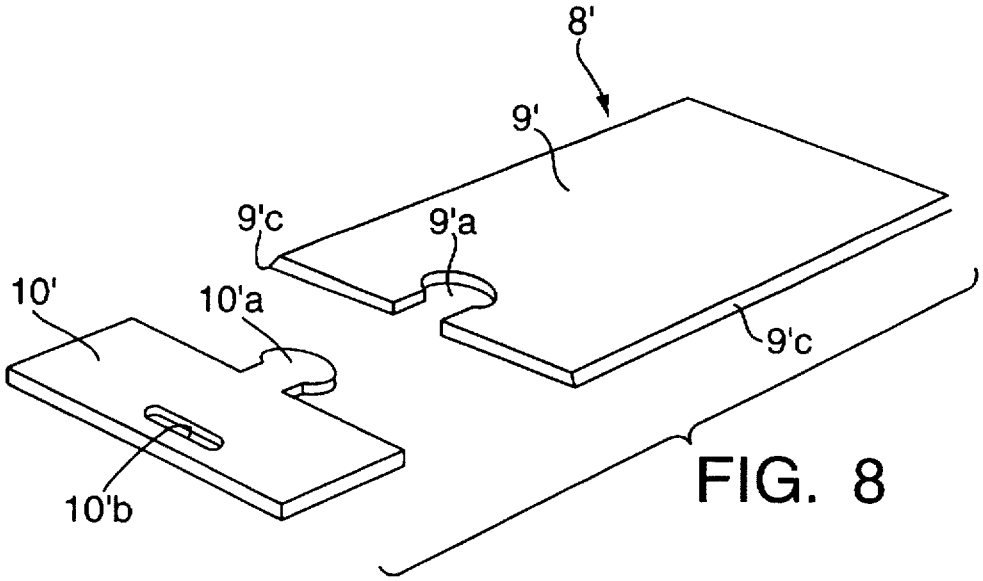
FIG. 8 is a perspective view of a bed slide which is separated.
Figure 9:
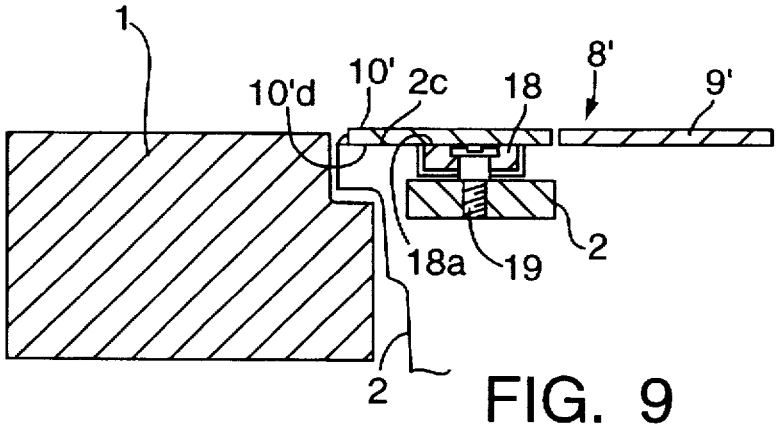
FIG. 9 is a cross sectional view taken along the line IX—IX of FIG. 7.
Figure 10:
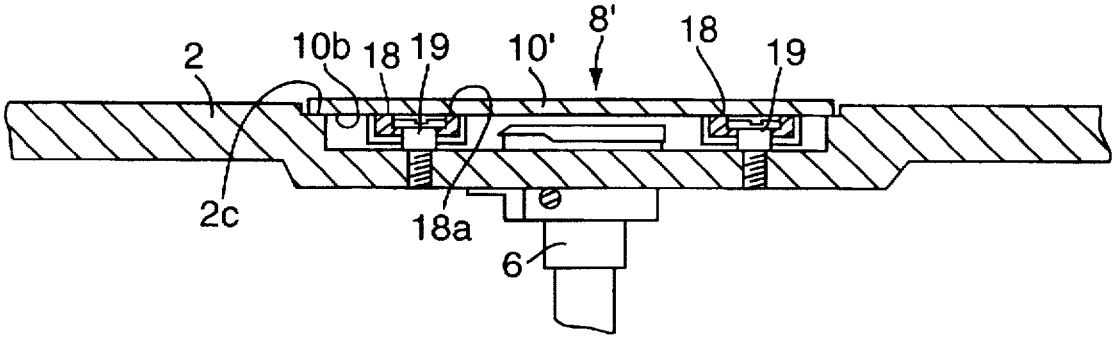
FIG. 10 is a cross sectional view taken along the line X—X of FIG. 7.

A left bed slide 8' of the second embodiment is disposed at a portion adjacent to the left side of the throat plate 3 and it comprises a bed slide body 9' which is freely slidable only on the bed 2 and a closing plate 10' which is formed of a magnetic material and is disposed at a portion adjacent to the bed slide body 9' in the sliding direction of the bed slide body 9' wherein the closing plate 10' is structured to be connectable and separable in the lateral direction with respect to the bed slide body 9'. That is, as shown in FIG. 8, a slot defining a concave end 9' a having such a shape that it is enlarged at one end thereof is formed by being notched at the other end (the end remote from the throat plate 3) of the bed slide body 9', and a protrusion defined by the closing plate having an enlarged convex tip adapted to be releasably received in the slot 10'*a*.

Meanwhile, the convex tip 10'*a* of the closing plate 10' can be engaged in the concave 9'*a* of the bed slide body 9' from the upper portion of the bed slide body 9'. In a state where the convex tip 10'*a* is engaged in the concave end 9'*a*, it is impossible to separate the closing plate 10' from the bed slide body 9' in the lateral direction, and the closing plate 10' is positioned with respect to and integrated with the bed slide body 9'. Further, when the operator catches his or her fingers in a retaining concave 10'*b* of the closing plate 10' to pull up the closing plate 10', the convex tip 10'*a* can be moved away from the concave end 9'*a* of the bed slide body 9'.

Dovetail parts 9'*c* having such an arrangement are slidably retained by sliding grooves 2*b* of the bed 2 which extend in parallel with each other in the lateral direction and confront back-and-forth as shown in FIG. 11. The closing plate 10' is placed on the stage surface 2*c* connected to the lower surfaces of the sliding grooves 2*b* of the bed 2, and it can be moved upward without interfering with the sliding grooves 2*b*. That is, the bed slide body 9' can slide only in the lateral direction while the dovetail parts 9'*c* of the bed slide body 9' are retained by the sliding grooves 2*b* comprising dovetail grooves. The closing plate 10' is shorter than the bed slide body 9' in the width of the back and forth direction by a pair of dovetail parts 9'*c*, and portions adjacent to the back-and-forth end surfaces 10'*d* as shown in one dotted chain line in FIG. 11 do not interfere with the sliding grooves 2*b*.

On the other hand, fixing means for detachably fixing the closing plate 10' onto the bed 2 are provided on the bed 2 wherein the fixing means are positioned under the closing plate 10' in a state where the convex 10'*a* is engaged in the concave 9'*a* of the bed slide body 9'. This fixing means comprises magnets 18 each formed of a permanent magnet. The magnets 18 are fixed to the bed 2 by fixing threads 19. The upper surface 18*a* of each magnet 18 is flush with a lower surface 1O'*d* of the closing plate 10' in a state where the closing plate 10' is placed on the stage surface 2*c* of the bed 2 so as to attract the closing plate 10'.

The operation of the left bed slide 8' will be now described hereafter.

The operator catches his or her fingers in the retaining concave 10'*b* to remove the closing plate 10' upward against the attraction of the magnets 18 when the bobbin or bobbin case is replaced with another one for supplying the bobbin thread while the space over the hook 6 is opened. Since the operator can catch his or her fingers in the concave 9'*a* so as to slide the bed slide body 9' leftward when the closing plate 10' is removed, so that the space over the hook 6 at the left side of the bed 2 can be opened. Since the bed slide body 9' can be freely moved in the sliding grooves 2*b* of the bed 2 by the length of the removed closing plate 10' in the lateral direction, it is possible to obtain an opening necessary for replacing the bobbin over the hook 6 without interfering with the upper surface of the machine table 1. In this state, the operator replaces the bobbin or bobbin case in the hook 6 with another one.

Since the bed slide body 9' can be slid while the operator catches his or her fingers in the concave 9'*a* in the manner set forth above, it is not necessary to form an exclusive concave for catching the operator's fingers in the bed slide body 9'. Further, it is possible to allow the upper surface of the bed slide body 9' to be flat in a state where the convex 10'*a* of the closing plate 10' is engaged in the concave 9'*a* of the bed slide body 9'.

Still further, it is not necessary to move the bed slide body 9' to be positioned onto the upper surface of the machine table 1 so as to open the space over the hook 6. Accordingly, it is possible to permit the upper surface of the machine table 1 to be flush with the upper surface of the bed 2 so as to form a substantially the same plane surface. As a result, it is possible to solve the problem that the cloth is prevented from being handled during the sewing operation which is caused by the stage difference between the upper surface of the machine table 1, that of the bed 2 and that of the left bed slide 8'. It is needless to say that a concave such as the concave 2*a* in the bed 2 (shown in FIGS. 7 and 12) which is defined corresponding to the left bed slide 8' need not be formed so as to receive the left bed slide 8', whereby the cloth is prevented from being handled during the sewing operation. It is further needless to say that the same plane surface is provided on the upper surface of the closing plate 10' and that of the bed slide body 9' and it is also provided on the upper surfaces of these closing plate 10' and the bed slide body 9' and that of the bed 2.

After the bobbin or bobbin case is replaced with another one, the bed slide body 9' is slidably moved rightward (in the direction opposite to the arrow A). Successively, the closing plate 10' is placed on the stage surface 2*c* of the bed 2 and the convex tip 10'*a* of the closing plate 10' is engaged in the concave end of the slot 9'*a* of the bed slide body 9' from the upper portion of the bed slide body 9'. As a result, the space over the hook 6 is closed.

It is possible to attach the closing plate 10' to one end of the bed slide body 9' (end close to the throat plate 3). In this case, the closing plate 10' which is slightly unstable is jolted near the throat plate 3, which causes a problem of preventing the sewing operation. Accordingly, it is preferable that the slightly unstable closing plate 10' is disposed at the other end of the bed slide body 9' (end remote from the throat plate 3). Since the sliding grooves 2*b* of the bed 2 extend to the left ends of the bed 2, the bed 2 is pushed up forward together with the arm, not shown, and the entire of the left bed slide 8' can be removed from the bed 2 at the position where the bed slide body 9' does not interfere with the upper surface of the machine table 1.

Meanwhile, it is possible to adopt various mechanical means instead of the magnets 18 as the fixing means for detachably fixing the closing plate 10'. For example, it is possible to structure the fixing means by disposing the curved portion 14*a* of the hinge pin presser bar spring 14 and the hinge pin presser bar spring receiver 16 wherein the curved portion 14*a* is elastically moved away from the hinge pin presser bar spring receiver 16 so as to separate the closing plate 10' from the bed slide body 9'. If the fixing means is structured by the mechanical means, the closing plate 10' need not be formed by the magnetic material.

As is evident from the above explanation, the following effects can be obtained by the bed slide device of the present invention.

The bed slide body and the closing plate are disposed on the bed, thereby providing the bed slide device. The space defined over the hook can be opened by the width of the closing plate in a state where the closing plate is moved.

If the present invention is applied to the bed slide device having the structure wherein the bed is slidably moves on the upper surface of the machine table, the bed slide body need not be moved to be positioned onto the upper surface of the machine table so as to open the space over the hook. Accordingly, the operation to open the space over the hook by sliding the bed slide body can be performed without concerning the interference with the machine table.

Accordingly, it is possible to provide substantially the same plane surface on the upper surface of the machine table and that of the bed. As a result, it is possible to solve the problem for preventing the cloth from being handled during the sewing operation owing to the stage difference between the upper surface of the machine table and that of the bed or that of the slide body.

Still further, it is not necessary to open or close the bed slide at the position where the operator pushes up the bed forward so that the lower surface of the bed slide does not interface with the upper surface of the machine table. Accordingly, it is possible to provide the bed slide device which is simple in structure with low cost, thereby permitting the operator to be released from the operation to push up the heavy bed forward every time the bobbin is replaced with another one. It is also possible to provide the bed slide device which is excellent in working efficiency and which secures the safety and protection of the operator. Particularly, when the present invention is applied to the left bed slide of the industrial sewing machine having two needles, there is a remarkable effect that the operator can be released from the operation to push up the heavy bed forward.

Further, when the present invention is applied to the bed slide device of the sewing machine having the bed slide which can slide only on the upper surface of the bed, a concave for receiving the bed slide needs not be defined in the upper surface of the bed. As a result, it is possible to make the upper surface of the bed flat, thereby solving the problem of preventing the handling of the cloth during sewing operation owing to the concave.

What is claimed is:

1. A bed slide device for a sewing machine including a bed having a stage surface, and a bed slide slidably provided on said bed for opening and closing a space over a hook, said bed slide comprising:

a bed slide body slidably provided on said bed; and a closing plate hingedly coupled to and supported by said bed slide body adjacent to said stage surface for movement between an open position and a closed position wherein the closing plate abuts said stage surface.

2. A bed slide device for a sewing machine as defined by claim 1, wherein:

said closing plate is vertically detachable from said bed slide body; and wherein fixing means are coupled to said closing plate for releasably coupling said closing plate to said bed.

3. A bed slide device for a sewing machine as defined by claim 2, wherein said closing plate defines a protrusion extending therefrom having an enlarged convex tip at an end thereof,, and wherein said bed slide body defines a slot having an enlarged concave end surface adapted to releasably receive said convex tip, wherein said convex tip is releasable from said concave end surface in a vertical direction relative thereto.

* * * * *